US012760402B2

(12) United States Patent
Shibata et al.

(10) Patent No.: US 12,760,402 B2
(45) Date of Patent: Oct. 13, 2026

(54) VACUUM CARBURIZING FURNACE AND VACUUM CARBURIZING TREATMENT METHOD

(71) Applicant: DOWA THERMOTECH CO., LTD., Tokyo (JP)

(72) Inventors: Daiki Shibata, Aichi (JP); Minoru Fujiwara, Aichi (JP); Masao Kanayama, Aichi (JP)

(73) Assignee: DOWA THERMOTECH CO., LTD., Tokyo (JP)

( * ) Notice: Subject to any disclaimer, the term of this patent is extended or adjusted under 35 U.S.C. 154(b) by 0 days.

(21) Appl. No.: 18/850,636

(22) PCT Filed: Mar. 24, 2023

(86) PCT No.: PCT/JP2023/011935

§ 371 (c)(1),
(2) Date: Sep. 25, 2024

(87) PCT Pub. No.: WO2023/190205

PCT Pub. Date: Oct. 5, 2023

(65) Prior Publication Data

US 2025/0101565 A1 Mar. 27, 2025

(30) Foreign Application Priority Data

Mar. 31, 2022 (JP) ..... 2022-058342

(51) Int. Cl.
*C23C 8/22* (2006.01)

(52) U.S. Cl.
CPC ..... *C23C 8/22* (2013.01)

(58) Field of Classification Search
CPC ..... C23C 14/586; C30B 35/005
See application file for complete search history.

(56) References Cited

U.S. PATENT DOCUMENTS

2002/0134467 A1* 9/2002 Kawata ..... C23C 8/20 266/78
2002/0144683 A1* 10/2002 Gurnee ..... A61G 10/026 128/205.24

FOREIGN PATENT DOCUMENTS

| | | | | |
|---|---|---|---|---|
| DE | 3233361 | A1 | | 3/1984 |
| JP | S63-262455 | A | | 10/1988 |
| JP | 2001158955 | A | * | 6/2001 |
| JP | 2005179714 | A | * | 7/2005 |
| JP | 2013-049898 | A | | 3/2013 |
| JP | 2016033240 | A | * | 3/2016 |
| JP | 2020-132961 | A | | 8/2020 |

OTHER PUBLICATIONS

JP2016033240, machine translation (Year: 2016).*
JP2001158955, machine translation (Year: 2001).*
JP2005179714, machine translation (Year: 2005).*

(Continued)

*Primary Examiner* — Robert A Vetere
(74) *Attorney, Agent, or Firm* — Greenblum & Bernstein, P.L.C.

(57) ABSTRACT

A vacuum carburizing furnace includes: a heating chamber in which a vacuum carburizing treatment is performed on a workpiece to be charged from outside the furnace; and a charging port for the workpiece, the charging port provided at a bottom portion of the heating chamber.

6 Claims, 7 Drawing Sheets

(A)

(B)

(56) References Cited

OTHER PUBLICATIONS

International Search Report issued in International Patent Application No. PCT/JP2023/011935, dated Jun. 6, 2023, along with an English translation thereof.
Written Opinion issued in International Patent Application No. PCT/JP2023/011935, dated Jun. 6, 2023, along with an English Translation thereof.
Extended European Search Report in counterpart EP application No. 23780215.2, dated Aug. 29, 2025.

* cited by examiner (A)

(B)

(A)

(B)

VACUUM CARBURIZING FURNACE AND VACUUM CARBURIZING TREATMENT METHOD

TECHNICAL FIELD

The present invention relates to a vacuum carburizing furnace and a vacuum carburizing treatment method.

BACKGROUND ART

A carburizing treatment has been conventionally performed as a heat treatment for hardening surfaces of workpieces such as automobile parts and machine parts made of various steel materials. In recent years, from the viewpoint of reducing CO2 emissions during the carburizing treatment, a vacuum carburizing treatment technique has become popular, in which a carburizing gas is added directly under reduced pressure, and the surface of the workpiece is impregnated with carbon produced by decomposition of the added carburizing gas. As a conventional vacuum carburizing furnace that performs such a vacuum carburizing treatment, Patent Document 1 has disclosed a vacuum carburizing furnace that includes two chambers of a heating chamber and a cooling chamber, divided by an intermediate vacuum door, with a charging door for charging workpieces provided at the front of the heating chamber and a conveyance-out door for conveying out workpieces provided at the rear of the cooling chamber.

PRIOR ART DOCUMENT

Patent Document

Patent Document 1: Japanese Laid-open Patent Publication No. S63-262455

SUMMARY OF THE INVENTION

Problems to be Solved by the Invention

In the vacuum carburizing furnace described in Patent Document 1, when a workpiece is charged into the heating chamber, the inside of the heating chamber is heated in an atmospheric pressure state and to a predetermined temperature in advance, and the workpiece is horizontally charged from the front of the heating chamber in that state.

However, the results of a simulation conducted by the present inventors revealed that in the vacuum carburizing furnace having a structure in which the workpiece is charged horizontally into the heating chamber, outside air flows into the heating chamber in a short period of time when the charging door for charging workpieces is opened.

The inside of the heating chamber is usually in a high temperature state at 800 to 900° C., and thus when outside air flows into the heating chamber when the workpiece is charged, oxidation of the structures inside the heating chamber is likely to occur. For this reason, it is necessary to apply oxidation-resistant materials to the materials of the structures inside the heating chamber.

Further, if the air remains in the heating chamber after the workpiece is charged and the charging door is closed, the surface of the workpiece is likely to oxidize, and thus it is preferable to perform vacuum evacuation before increasing the temperature inside the heating chamber up to a carburizing temperature.

However, the greater the amount of outside air that flows into the heating chamber when the workpiece is charged, the greater the amount of oxygen inside the heating chamber, and it takes time to reduce the oxygen partial pressure inside the heating chamber to an atmosphere in which the workpiece is less likely to oxidize. That is, the greater the amount of outside air that flows into the heating chamber, the longer the vacuum evacuation time becomes, and the longer it takes to start the carburizing treatment.

As above, in the vacuum carburizing furnace having a structure in which the workpiece is charged horizontally into the heating chamber, air flows into the heating chamber when the workpiece is charged, which limits the materials that can be applied to the structures inside the heating chamber and increases the time until start of the carburizing treatment.

The present invention has been made in consideration of the above-described circumstances, and an object thereof is to inhibit the inflow of outside air into a heating chamber when a workpiece is charged in a vacuum carburizing furnace.

Means For Solving the Problems

One aspect of the present invention solving the above-described problem is a vacuum carburizing furnace, the vacuum carburizing furnace including: a heating chamber in which a vacuum carburizing treatment is performed on a workpiece to be charged from outside the furnace; and a charging port for the workpiece, the charging port provided at a bottom portion of the heating chamber.

One aspect of the present invention according to another point of view is a vacuum carburizing treatment method, the vacuum carburizing treatment method including: supplying an inert gas into a heating chamber in which a carburizing treatment is performed on a workpiece, making the pressure in the heating chamber become a pressure equal to or higher than an atmospheric pressure, and then opening a charging port for the workpiece provided at a bottom portion of the heating chamber; charging the workpiece from the charging port; increasing the temperature inside the heating chamber to a temperature at which a vacuum carburizing treatment is performed; and supplying a carburizing gas into the heating chamber that has been vacuum-evacuated and performing a vacuum carburizing treatment on the workpiece.

Effect of the Invention

According to the present invention, it is possible to inhibit the inflow of outside air into a heating chamber when a workpiece is charged in a vacuum carburizing furnace.

EMBODIMENTS FOR CARRYING OUT INVENTION

Figure 1:
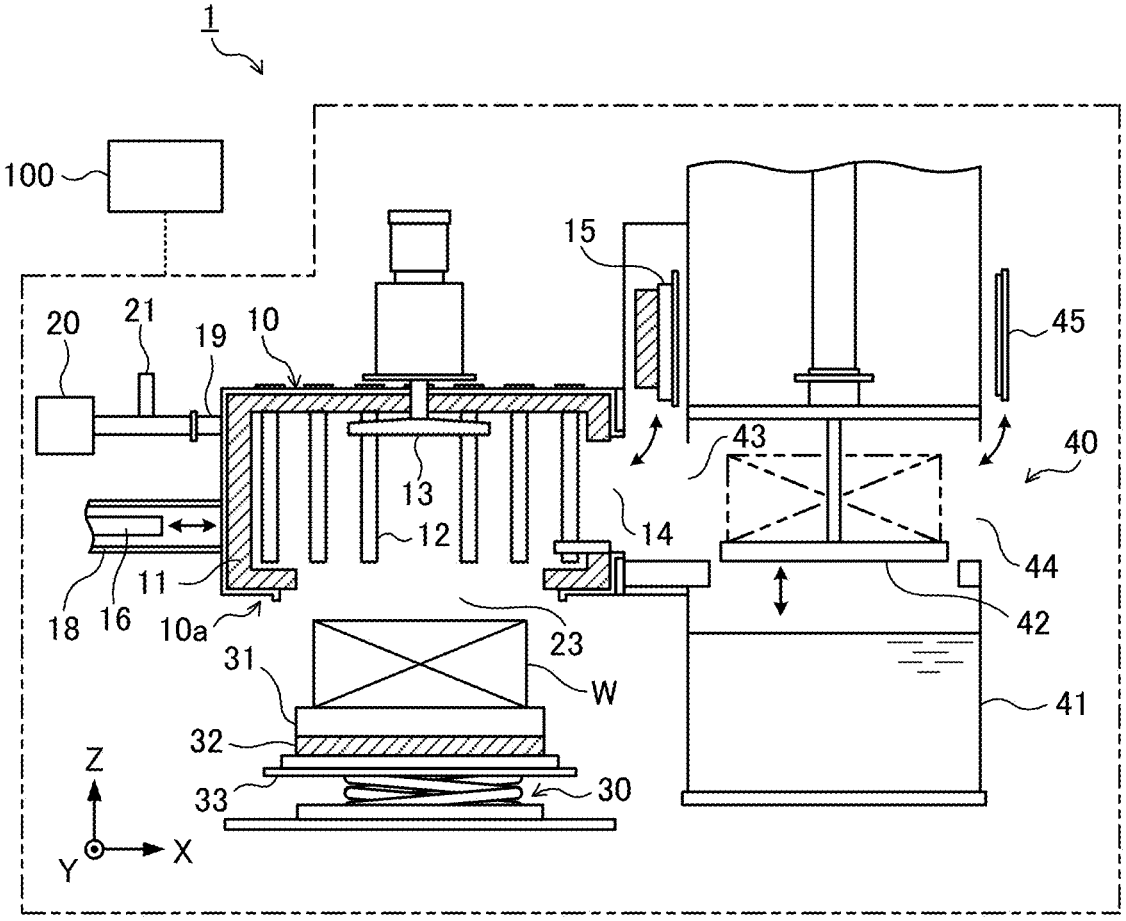
FIG. 1 is an explanatory view illustrating a schematic configuration of a vacuum carburizing furnace according to one embodiment of the present invention.

Hereinafter, an embodiment according to the present invention will be explained referring to the drawings. Incidentally, in this description and the drawings, the same reference numerals and symbols are given to components having substantially the same functional configurations to omit duplicated explanation.

Figure 2:
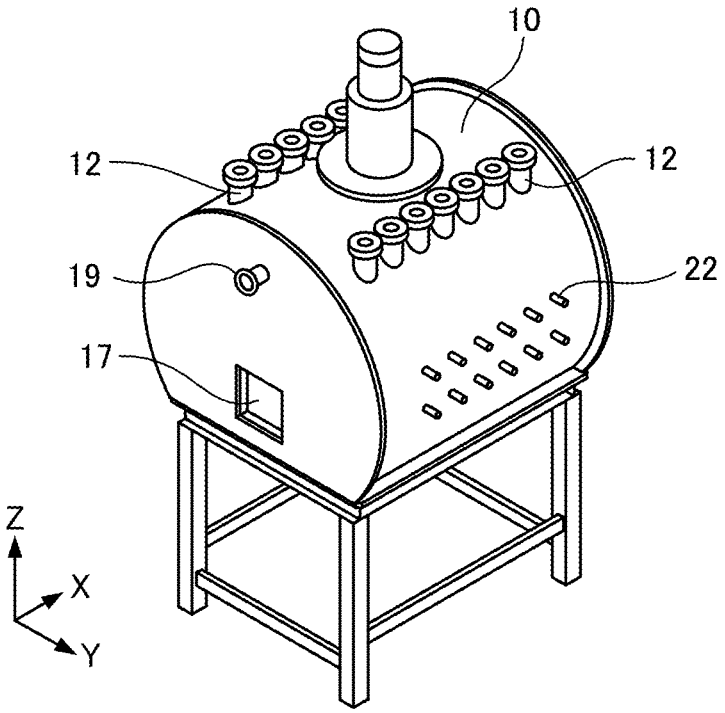
FIG. 2 is a perspective view for explaining a heating chamber.

FIG. 1 is an explanatory view illustrating a schematic configuration of a vacuum carburizing furnace according to this embodiment. FIG. 2 is a perspective view for explaining a heating chamber. In this embodiment, the X direction illustrated in the drawing is the width direction of a vacuum carburizing furnace 1, the Y direction is the depth direction of the vacuum carburizing furnace 1, and the Z direction is the height direction of the vacuum carburizing furnace 1.

<Vacuum Carburizing Furnace>

The vacuum carburizing furnace 1 includes a heating chamber 10 in which a vacuum carburizing treatment is performed on workpieces W such as automobile parts and machine parts made of various steel materials, which are charged from outside the furnace, and a cooling chamber 40 arranged adjacent to the heating chamber 10.

(Heating Chamber)

The heating chamber 10 is a substantially cylindrical container whose axial direction faces the X direction, and a heat insulating material 11 is provided on the inner surface of the heating chamber 10. Inside the heating chamber 10, a plurality of heaters 12 extending downward in the Z direction from a ceiling portion are installed, and the respective heaters 12 are arranged at intervals in the X direction. As the heater 12, a ceramic heater such as a SiC heater, or a well-known heating device such as an electric burner or a gas burner can be applied, but from the viewpoint of inhibiting deterioration of the heater caused by oxidation at high temperatures, it is preferable to use the ceramic heater. A stirring fan 13 for stirring the atmosphere inside the heating chamber 10 is attached to the center of the ceiling portion of the heating chamber 10.

A conveyance port 14 for conveying the workpiece W from the heating chamber 10 to the cooling chamber 40 is formed in a side wall of the heating chamber 10 on the cooling chamber 40 side. Further, a rising and lowering door 15 is provided between the heating chamber 10 and the cooling chamber 40, and the conveyance port 14 is opened or closed by the door 15.

A pusher 16 for pushing the workpiece W from the heating chamber 10 into the cooling chamber 40 is provided at the side wall opposite to the side wall of the heating chamber 10 with the above-described conveyance port 14 formed therein. The pusher 16 includes a linear movement mechanism (not illustrated) such as a linear guide, for example, and is configured to be freely movable in the X direction.

As illustrated in FIG. 2, an opening portion 17 for the pusher 16 is formed in the side wall of the heating chamber 10, and when pushing out the workpiece W, the pusher 16 passes through the opening portion 17.

As illustrated in FIG. 1, the pusher 16 is surrounded by a housing 18. This housing 18 is fixed to the side wall of the heating chamber 10 so as to cover the opening portion 17 illustrated in FIG. 2 (the housing 18 is not illustrated in FIG. 2). The housing 18 has a sealed structure to prevent outside air from flowing into the heating chamber 10 during the vacuum carburizing treatment on the workpiece W.

An exhaust pipe 19 that exhausts the atmosphere inside the heating chamber 10 is provided above the housing 18. The exhaust pipe 19 is connected to a vacuum pump 20. Further, a pressure gauge 21 is attached to the exhaust pipe 19, and this pressure gauge 21 measures the pressure inside the heating chamber 10. Incidentally, as long as the pressure inside the heating chamber 10 can be measured, there is no particular limitation on the position where the pressure gauge 21 is installed. Further, from the viewpoint of reducing carbon dioxide emissions, a carbon dioxide capture device (not illustrated) may be attached to the exhaust pipe 19.

As illustrated in FIG. 2, a gas inlet 22 serving as a gas supply port is provided in the outer circumferential surface of a cylindrical portion of the heating chamber 10. This gas inlet 22 supplies gases such as a carburizing gas (for example, an acetylene gas, an ethylene gas, a propane gas, a butane gas, or a mixture of these gases), an inert gas (for example, a nitrogen gas, an argon gas), and an oxidizing gas (for example, air, oxygen, carbon dioxide) into the heating chamber 10.

A plurality of the gas inlets 22 are provided along the X direction and the Y direction, and the respective gas inlets 22 are arranged at intervals from each other. Incidentally, although not illustrated in FIG. 2 because they are hidden by the heating chamber 10, the same gas inlets are provided in the outer circumferential surface of the cylindrical portion of the heating chamber 10 at the positions facing the gas inlets 22 illustrated in FIG. 2. That is, in the heating chamber 10, a pair of gas inlets 22 is provided so as to sandwich the heating chamber 10 therebetween, and the gas to be supplied to the heating chamber 10 is supplied from two directions on the sides of the heating chamber 10.

Gas supply pipes (not illustrated) are connected to the respective gas inlets 22. Of a plurality of the gas supply pipes, for example, some are connected to a cylinder (not illustrated) in which a carburizing gas is stored, others are connected to a cylinder (not illustrated) in which an inert gas is stored, and the others are connected to a cylinder (not illustrated) in which an oxidizing gas is stored or an air compressor (not illustrated). With such a gas supply system, the gas to be supplied into the heating chamber 10 can be switched, and the atmosphere inside the heating chamber 10 can be switched to a carburizing gas atmosphere, an inert gas atmosphere, an oxidizing gas atmosphere, or a mixed atmosphere of these gases.

Incidentally, a plurality of the gas inlets 22 do not need to be installed, and for example, a configuration may be employed in which the respective gases of carburizing gas, inert gas, and oxidizing gas in an appropriate mixed state are supplied from the single gas inlet 22.

Regarding the positional relationship between the exhaust pipe 19 and the gas inlet 22, in this embodiment, the exhaust pipe 19 is provided in the side wall of the heating chamber 10 on the side opposite to the side wall on the cooling chamber 40 side, and the gas inlet 22 is provided in the side wall different from the side wall in which the exhaust pipe 19 is installed. In other words, the exhaust pipe 19 and the gas inlet 22 are provided to make the extending direction of the exhaust pipe 19 (the X direction in this embodiment) and the extending direction of the gas inlet 22 (the Y direction in this embodiment) intersect. The positional relationship between the exhaust pipe 19 and the gas inlet 22 is not particularly limited, but the arrangement as in this embodiment is preferable due to the following reasons.

In the furnace having a structure in which the workpiece W is charged horizontally into the heating chamber, such as a conventional vacuum carburizing furnace, the charging port for the workpiece W was required to be formed in the side wall in which the opening portion 17 and the exhaust pipe 19 in this embodiment are provided. That is, in the conventional vacuum carburizing furnace, it was not possible to set the position where the exhaust pipe is attached to the position where the exhaust pipe 19 in this embodiment is attached, and the positional relationship between the exhaust pipe 19 and the gas inlet 22 was not able to be the same as that in this embodiment.

In contrast to this, the positional relationship between the exhaust pipe 19 and the gas inlet 22 as in this embodiment makes it possible to increase the distance between the supply position of the gas to be supplied into the heating chamber 10 and the exhaust position more than that in the conventional vacuum carburizing furnace. This makes it possible to inhibit the occurrence of a phenomenon in which the gas supplied to the heating chamber 10 is exhausted before being diffused inside the heating chamber 10 (what is called a short pass). Therefore, for example, during the vacuum carburizing treatment, the vacuum carburizing treatment can be performed in a state where the carburizing gas supplied to the heating chamber 10 is sufficiently diffused inside the heating chamber 10, making it possible to inhibit carburizing variation.

Of the gases supplied from the gas inlets 22, the inert gas is supplied as needed during the process of performing the vacuum carburizing treatment on the workpiece W. For example, the inert gas is supplied during the step of charging the workpiece W into the heating chamber 10, the step of conveying the workpiece W from the heating chamber 10 to the cooling chamber 40, and a carburizing and diffusion step.

On the other hand, the oxidizing gas is supplied as needed during the process of performing the vacuum carburizing treatment on the workpiece W and during regular maintenance work after the vacuum carburizing treatment. For example, the oxidizing gas is supplied when performing burnout in which soot accumulated in the heating chamber 10 is removed by combustion, as the regular maintenance work. As will be described later, the vacuum carburizing furnace 1 according to this embodiment has a structure in which the inflow of outside air into the heating chamber 10 does not easily occur, and thus the burnout can be effectively performed by supplying the oxidizing gas from the gas inlet 22.

As illustrated in FIG. 1, a charging port 23 for charging the workpiece W is formed at a bottom portion 10*a* of the heating chamber 10. Therefore, when charged into the heating chamber 10, the workpiece W is charged from below the heating chamber 10. As will be explained in a later-described example, when the workpiece W is charged from below the heating chamber 10, the inflow of outside air into the heating chamber 10 when the workpiece W is charged can be inhibited.

Figure 3:
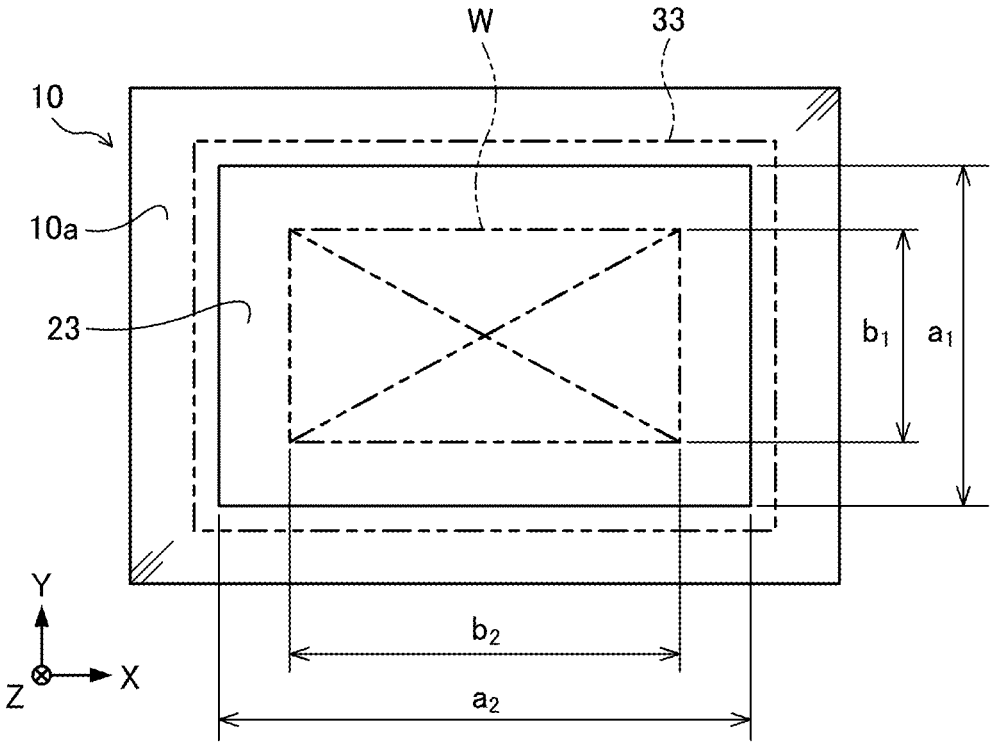
FIG. 3 is an explanatory view for explaining the size of a charging port, viewed from below the heating chamber.

FIG. 3 is a view of the heating chamber 10 viewed from below. As illustrated in FIG. 3, the charging port 23 has a size large enough for the size of the workpiece W. On the other hand, from the viewpoint of inhibiting the inflow of outside air into the heating chamber 10 when the workpiece W is charged, it is preferable that the size of the charging port 23 with respect to the workpiece W should not be excessively large.

Specifically, when the vertical width (length in the Y direction) of the charging port 23 is set to $a_1$ and the vertical width (length in the Y direction) of the workpiece W is set to $b_1$, the vertical width ratio ($a_1/b_1$) is preferably 1.80 or less. More preferably, it is 1.70 or less, and further preferably, it is 1.60 or less or 1.50 or less. On the other hand, to more reliably avoid interference between the charging port 23 and surrounding parts for raising and lowering the workpiece W, the vertical width ratio ($a_1/b_1$) is preferably 1.01 or more, and more preferably 1.02 or more.

Further, when the horizontal width (length in the X direction) of the charging port 23 is set to $a_2$ and the horizontal width (length in the X direction) of the workpiece W is set to $b_2$, the horizontal width ratio ($a_2/b_2$) is preferably 1.80 or less for the same reasons as those for specifying a preferable upper limit value of the above-described vertical width ratio. More preferably, it is 1.70 or less, and further preferably, 1.60 or less or 1.50 or less. Further, for the same reasons as those for specifying a preferable lower limit value of the above-described vertical width ratio, the horizontal width ratio ($a_2/b_2$) is preferably 1.01 or more, and more preferably 1.02 or more.

Incidentally, in the example illustrated in FIG. 3, the charging port 23 has a rectangular shape, but the shape of the charging port 23 is not particularly limited as long as it is a shape that allows the workpiece W to be charged therethrough, and it may be, for example, a circular shape, an elliptical shape, or another shape.

(Elevator)

As illustrated in FIG. 1, a scissor lifter 30 is provided below the heating chamber 10 as an elevator for charging the workpiece W into the heating chamber 10 from the charging port 23. Above the scissor lifter 30, there are provided a support table 31 that supports the workpiece W, a heat insulating material 32 provided under the support table 31, and a lid body 33 arranged below the heat insulating material 32. The upper end portion of the scissor lifter 30 is connected to the lower surface of the lid body 33, and the lid body 33 is configured to rise and lower in conjunction with a rising and lowering movement of the scissor lifter 30.

The lid body 33 is a member that closes the charging port 23 and also functions as a bottom wall portion of the heating chamber 10, and has a shape that covers the entire charging port 23. The lid body 33 is raised by the scissor lifter 30 to come into close contact with the bottom portion 10*a* of the heating chamber 10, thereby closing the charging port 23.

Figure 4:
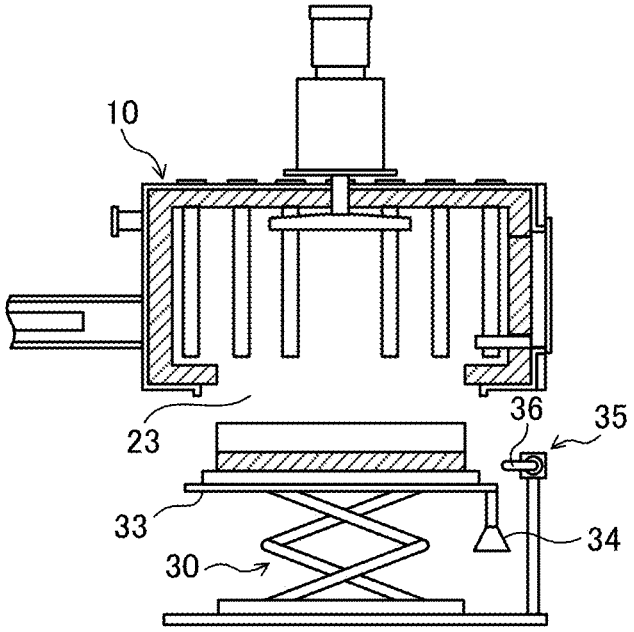
FIG. 4 is an explanatory view for explaining an opening/closing detection mechanism for the charging port.
Figure 4:
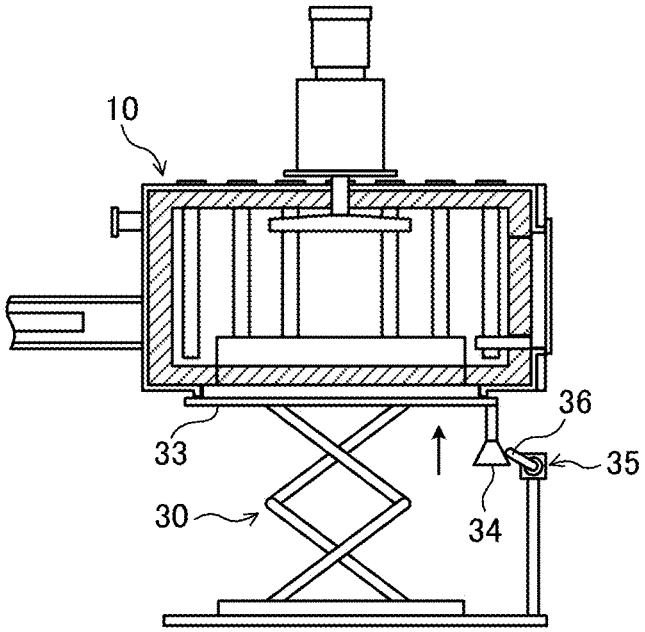

In the vacuum carburizing furnace 1, it is preferable to provide an opening/closing detection mechanism for the charging port 23. One example of this opening/closing detection mechanism will be explained with reference to FIG. 4.

In the example illustrated in FIG. 4(A), a substantially trapezoidal-shaped contact member 34 is provided below a peripheral edge portion of the lid body 33. This contact member 34 is directly or indirectly connected to the lid body 33 so as to rise and lower in conjunction with the rising and lowering movement of the lid body 33.

A limit switch 35 is provided on the side of the contact member 34 as an opening/closing detection sensor for the charging port 23. The limit switch 35 includes a detection part 36 extending horizontally, and the detection part 36 is rotatable around the Y direction as a rotation axis. The limit switch 35 outputs an ON signal to a later-described control device 100 when the rotation angle of the detection part 36 from the initial position reaches a predetermined angle.

The height at which the detection part 36 is installed is set to a height at which the limit switch 35 is brought into an OFF state at the stage before the charging port 23 is closed by the lid body 33, and the limit switch 35 is brought into an ON state when the charging port 23 is closed by the lid body 33.

In the case where the limit switch 35 is installed in this manner, as illustrated in FIG. 4(A), before the charging port 23 is closed by the lid body 33, the detection part 36 is located above the contact member 34, and the contact member 34 and the detection part 36 are in a non-contact state. At this stage, the detection part 36 is at the initial position, and the limit switch 35 is in an OFF state.

On the other hand, as illustrated in FIG. 4(B), when the charging port 23 is closed by the lid body 33, the contact member 34 comes into contact with the detection part 36, and the rotation angle of the detection part 36 from the initial position reaches a predetermined angle. As a result, the limit switch 35 is brought into an ON state, and the control device 100 determines that the charging port 23 is closed.

That is, the OFF state and the ON state of the limit switch 35 are switched, thereby making it possible to automatically detect the open/close state of the lid body 33. Such an opening/closing detection mechanism makes it possible to detect that the charging port 23 has been opened by the limit switch 35 when, after the workpiece W is charged, the lid body 33 lowers at an unprescribed timing, for example, due to the weight of the workpiece W, the lid body 33, or the like.

Then, when opening of the charging port 23 is detected, a rise signal is output from the later-described control device 100 to the scissor lifter 30, and the lid body 33 can be raised until the limit switch 35, which is in an ON state, is brought into an OFF state again. This makes it possible to continue the vacuum carburizing treatment on the workpiece W without stopping the operation of the vacuum carburizing furnace 1.

Incidentally, the above-described "unprescribed timing" means a timing at which the charging port 23 should not be opened essentially, and a specific timing is to be appropriately determined by those skilled in the art in consideration of actual operations. For example, when the timing of scheduled opening of the charging port 23 is set to the time when the workpiece is charged into the heating chamber 10, the unprescribed timing is the timings other than the time when the workpiece is charged.

Further, the above-described opening/closing detection mechanism is not limited to the mechanism using the limit switch 35, but a mechanism using a proximity sensor, a photoelectric sensor, a laser sensor, or the like can also be applied.

The elevator that raises and lowers the lid body 33 has been explained above, but the elevator is not limited to the scissor lifter 30 and may be an elevator that uses another mechanism such as a mechanism that utilizes the extension and contraction movement of a hydraulic cylinder, for example.

Further, the vacuum carburizing furnace 1 in this embodiment employs the configuration in which the scissor lifter 30 and the lid body 33 are integrated by being connected to each other, but does not have to employ the configuration in which the scissor lifter 30 and the lid body 33 are constantly connected. For example, a configuration may be employed in which, after the scissor lifter 30 raises the lid body 33 to close the charging port 23, the position of the lid body 33 is fixed by another support means for supporting the lid body 33 and the scissor lifter 30 can be lowered.

Further, the configuration in which charging the workpiece W and closing the charging port 23 are achieved is not limited to the configuration of raising and lowering the lid body 33, as long as the workpiece W can be charged from the charging port 23 and the charging port 23 can be closed.

(Cooling Chamber)

In the cooling chamber 40 arranged adjacent to the heating chamber 10, the workpiece W that has been subjected to the vacuum carburizing treatment is cooled. The cooling chamber 40 illustrated in FIG. 1 is an oil-cooled type cooling chamber, and includes an oil tank 41 in which oil for quenching is stored.

Above this oil tank 41, there is a conveyance space for the workpiece W. In the conveyance space, an elevator rack 42 to raise and lower the workpiece W between the conveyance space and the oil tank 41 is provided. A conveyance port 43 for conveying the workpiece W to the cooling chamber 40 is formed in the side wall of the cooling chamber 40 on the heating chamber 10 side, and a conveyance-out port 44 for conveying the workpiece W out of the cooling chamber 40 is formed in the side wall on the side opposite to the side wall in which the conveyance port 43 is formed. Further, a rising and lowering door 45 for closing the conveyance-out port 44 is provided at the outer side of the side wall in which the conveyance-out port 44 is formed.

Incidentally, the cooling method in the cooling chamber 40 is not limited to the oil cooling, and may be another cooling method such as gas cooling. Further, the cooling chamber 40 does not have to be arranged adjacent to the heating chamber 10, and the workpiece W that has been conveyed out of the heating chamber 10 may be charged into the cooling chamber 40 arranged at a distance from the heating chamber 10.

(Control Device)

The above-described vacuum carburizing furnace 1 includes the control device 100. The control device 100 is, for example, a computer including a CPU, a memory, and the like, and includes a program storage unit (not illustrated). The program storage unit stores various programs that control a series of processing in the vacuum carburizing furnace 1. For example, the program storage unit stores a program for controlling the supply and exhaust of gas inside the heating chamber 10, a program for controlling the operation of the scissor lifter 30, and so on. Incidentally, the above-described programs may have been recorded on a computer-readable storage medium and installed into the control device 100 from the storage medium.

The vacuum carburizing furnace 1 according to this embodiment is configured as described above. Incidentally, although not explained in this description, the vacuum carburizing furnace 1 also includes components required for a typical vacuum carburizing furnace, such as a temperature sensor that measures the temperature inside the heating chamber 10.

<Vacuum Carburizing Treatment Method>

Next, there is explained one example of the vacuum carburizing treatment on the workpiece W in this vacuum carburizing furnace 1.

Figure 5:
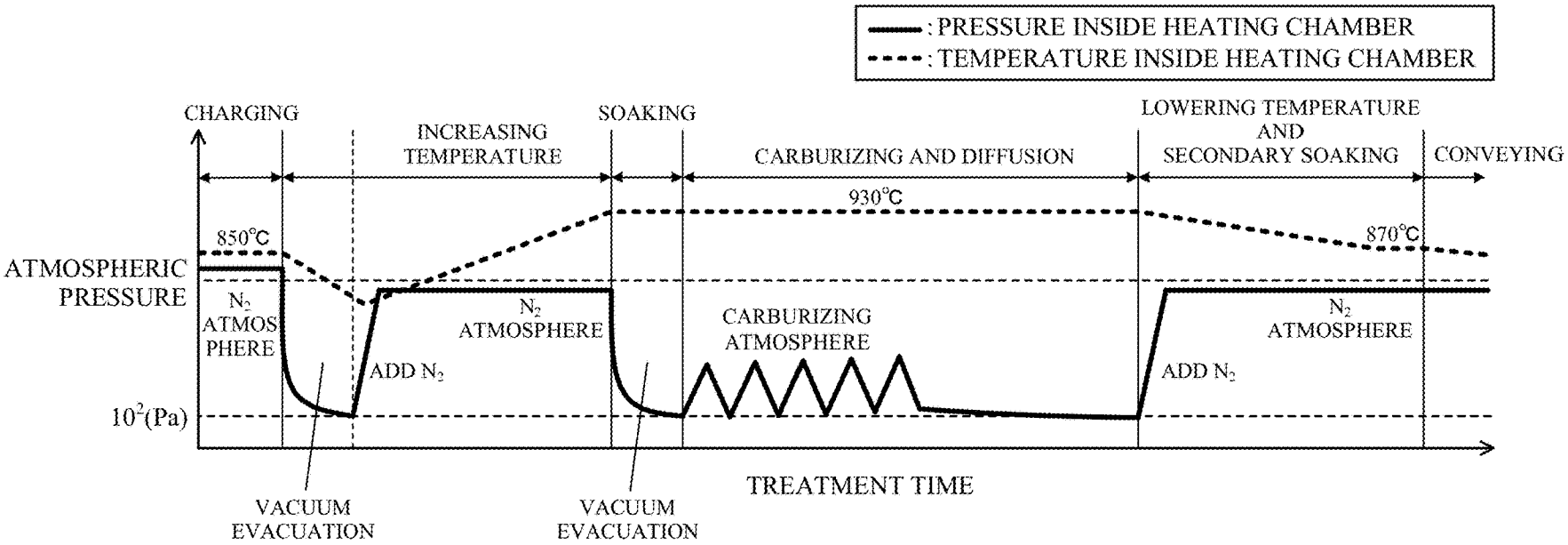
FIG. 5 is an explanatory view illustrating pressure history and temperature history inside the heating chamber from the step of charging the workpiece into the heating chamber to the step of conveying the workpiece to a cooling chamber.

FIG. 5 is an explanatory view illustrating pressure history and temperature history inside the heating chamber 10 from the step of charging the workpiece W into the heating chamber 10 to the step of conveying the workpiece W to the cooling chamber 40. In this embodiment, the respective operations of the vacuum carburizing furnace 1 to be explained below are controlled by the control device 100, and thereby the vacuum carburizing treatment on the workpiece W is automatically performed according to the treatment flow illustrated in FIG. 5. Incidentally, some of the operations of the vacuum carburizing furnace 1 to be explained below may be performed manually by an operator. Further, the "pressure" in the following explanation is absolute pressure.

(Charging Step)

First, at the stage before the charging port 23 is opened, a nitrogen gas, which is one example of the inert gas, is supplied into the heating chamber 10 from the gas inlet 22, and thereby the atmosphere inside the heating chamber 10 is a nitrogen gas atmosphere, which is one example of the inert gas atmosphere. That is, the atmosphere inside the heating chamber 10 is the atmosphere that inhibits oxidation of the workpiece W. The nitrogen gas atmosphere, which has a light gas specific gravity, is created inside the heating chamber 10, thereby making it possible to further inhibit the inflow of air into the heating chamber 10, which is preferable.

The pressure inside the heating chamber 10 at this time is set to, for example, $1\times10^4$ to $1.5\times10^5$ Pa, but is preferably a pressure equal to or higher than an atmospheric pressure. This results in a state where there is no pressure difference between the inside and outside of the heating chamber 10, or the pressure inside the heating chamber 10 is higher than the pressure outside the heating chamber 10, thus making it difficult for the outside air to flow into the heating chamber 10 when the charging port 23 is opened. Incidentally, when the pressure inside the heating chamber 10 is made higher than the pressure outside the heating chamber 10, the pressure difference is preferably $5\times10^4$ Pa or less.

Figure 6:
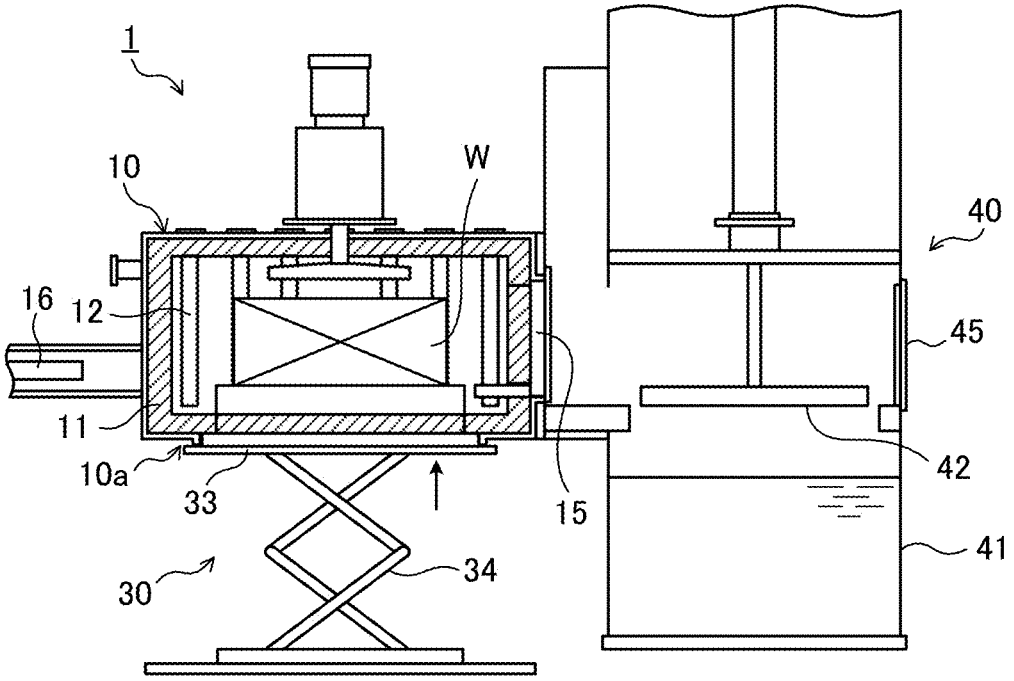
FIG. 6 is an explanatory view for explaining the step of charging the workpiece into the heating chamber and the step of conveying the workpiece to the cooling chamber.
Figure 6:
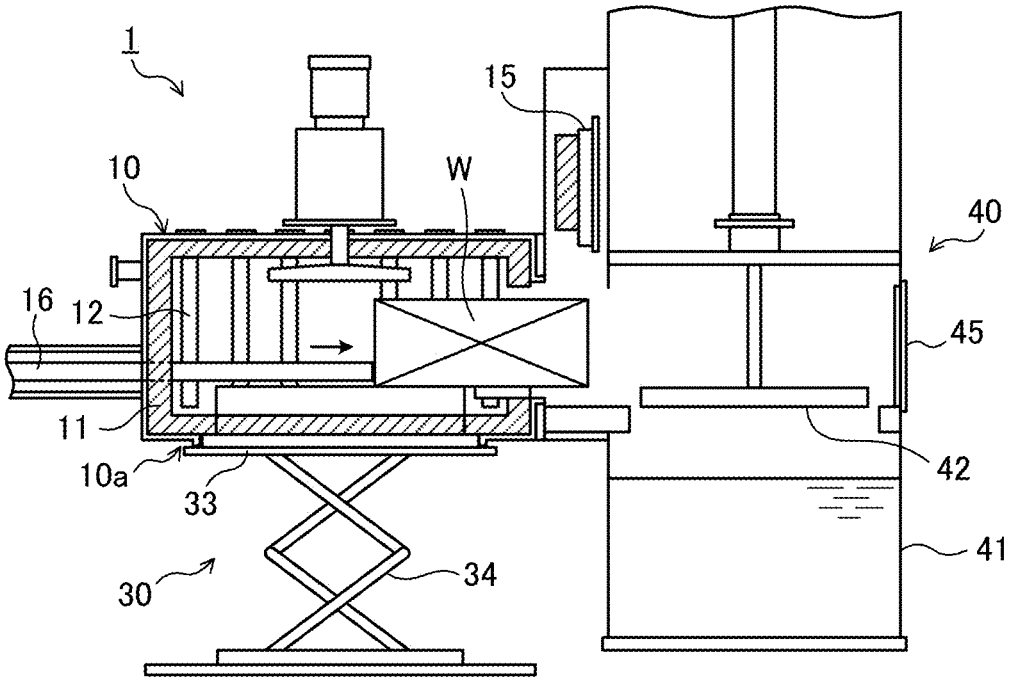

Next, the lid body 33 is lowered, thereby opening the charging port 23 provided at the bottom portion 10*a* of the heating chamber 10, and the workpiece W conveyed from outside the furnace by a conveying means such as a roller conveyor (not illustrated) is supported on the support table 31. Then, a signal instructing the scissor lifter 30 to rise is output from the control device 100, and the lid body 33 rises. As a result, as illustrated in FIG. 6(A), the bottom portion 10*a* of the heating chamber 10 and the lid body 33 come into close contact, the charging port 23 is closed, and the workpiece W is charged into the heating chamber 10 from the charging port 23.

Incidentally, from the viewpoint of inhibiting the inflow of outside air into the heating chamber 10, the pressure inside the heating chamber 10 is preferably maintained at a pressure equal to or higher than the atmospheric pressure by adjusting the amount of nitrogen gas supplied during the period from when the charging port 23 is opened until it is closed again.

Further, the temperature inside the heating chamber 10 when the workpiece W is charged is not particularly limited, but it is preferably a temperature of −100° C. to +100° C. relative to the temperature inside the heating chamber 10 when the workpiece W of one previous lot is conveyed from the heating chamber 10 to the cooling chamber 40. For example, in the case where the temperature inside the heating chamber 10 when the workpiece W of one previous lot is conveyed to the cooling chamber 40 is 870° C., the temperature inside the heating chamber 10 when the workpiece W of the next lot is charged is preferably 770 to 970° C.

Performing such temperature control makes it possible to inhibit excessive temperature drop inside the heating chamber 10, and shorten the time required from when the workpiece W of the next lot is charged until the temperature is increased to the carburizing temperature.

(Temperature Increasing Step)

After the workpiece W is charged into the heating chamber 10, vacuum evacuation inside the heating chamber 10 is performed. With this vacuum evacuation, the air remaining inside the heating chamber 10 is expelled, thereby inhibiting oxidation of the workpiece W while the temperature in the heating chamber 10 is increasing. Incidentally, this vacuum evacuation preferably reduces the pressure inside the heating chamber 10 to $1\times10^3$ Pa or less. More preferably, it is $5\times10^2$ Pa or less.

The vacuum evacuation time is preferably set to 50% or less of the time during the temperature increasing step as illustrated in FIG. 5. In other words, the inside of the heating chamber 10 during the temperature increasing step is preferably maintained to be in the inert gas atmosphere and a pressure of $1\times10^2$ Pa or more and less than the atmospheric pressure for the time of 50% or more of the time during the temperature increasing step. Incidentally, the vacuum evacuation time is preferably set to 30% or less of the time during the temperature increasing step. Such control for maintaining the atmosphere is preferably performed using the control device 100 described above. The time during the temperature increasing step is the time from when the charging port 23 is closed in the charging step until vacuum evacuation in a later-described soaking step is started.

Incidentally, the above-described vacuum evacuation may be omitted when the steel type of the workpiece W is a steel type that does not easily oxidize, depending on the required level of carburizing quality, or the like.

After a vacuum atmosphere inside the heating chamber 10 has been created by the above-described vacuum evacuation, the vacuum evacuation is stopped and a nitrogen gas is supplied into the heating chamber 10. Then, after the pressure inside the heating chamber 10 reaches a predetermined pressure (for example, $3\times10^4$ Pa), the supply of the nitrogen gas is stopped.

In the temperature increasing step, the pressure inside the heating chamber 10 is preferably less than the atmospheric pressure. More preferably, it is $1.0\times10^5$ Pa or less. This makes the pressure inside the heating chamber 10 lower than the pressure outside the heating chamber 10, and a force that presses the lid body 33 against the bottom portion 10*a* of the heating chamber 10 is applied. As a result, the close contact between the bottom portion 10*a* of the heating chamber 10 and the lid body 33 is easily maintained even in the case where an unexpected impact is applied to, for example, the heating chamber 10 or the scissor lifter 30.

In particular, in the vacuum carburizing furnace 1 having a structure in which the workpiece W is charged from below the heating chamber 10, the weights of heavy objects such as the workpiece W and the lid body 33 act on the scissor lifter 30 serving as an elevator. That is, a load in a direction in which the close contact between the bottom portion 10*a* of the heating chamber 10 and the lid body 33 is released is applied to the scissor lifter 30. Therefore, pressing the lid body 33 against the bottom portion 10*a* of the heating chamber 10 by the above-described control is useful from the viewpoint of maintaining the degree of airtightness inside the heating chamber 10. Incidentally, when the pressure inside the heating chamber 10 is made lower than the pressure outside the heating chamber 10, the pressure difference is preferably less than $1.0\times10^5$ Pa. More preferably, it is $1.0\times10^4$ Pa to $9.5\times10^4$ Pa.

Further, while the above-described nitrogen gas is being supplied, the heaters 12 and the stirring fan 13 are operated to increase the temperature inside the heating chamber 10 to a predetermined carburizing temperature (930° C.). In this temperature increasing step, since the inside of the heating chamber 10 does not have a vacuum atmosphere but has a nitrogen gas atmosphere, the temperature inside the heating chamber 10 increases easily, making it possible to shorten the temperature increasing time. Incidentally, the carburizing temperature is set appropriately depending on the type of steel of the workpiece W or the structure inside the furnace, and in the case of the vacuum carburizing treatment, it is set to 730 to 1200° C., for example.

(Soaking Step)

After the temperature inside the heating chamber 10 reaches the predetermined carburizing temperature, vacuum evacuation is performed again. By this vacuum evacuation, soaking of the workpiece W is performed before the carburizing treatment on the workpiece W is started. Incidentally, this vacuum evacuation preferably reduces the pressure inside the heating chamber 10 to $1\times10^3$ Pa or less. More preferably, it is $5\times10^2$ Pa or less.

Incidentally, the soaking step may be omitted. When the soaking step is omitted, vacuum evacuation is started in the middle of the previously-described temperature increasing step. In this case, the "time during the temperature increasing step," which is described previously, refers to the time from when the charging port 23 is closed during the charging step until the later-described supply of carburizing gas is started.

On the other hand, when the soaking step is omitted and vacuum evacuation is started in the middle of the temperature increasing step, convection heat transfer does not occur after the inside of the heating chamber 10 has a vacuum atmosphere. In such an environment where convection heat transfer does not occur, the temperature variation of the workpiece W during the temperature increasing step is more likely to occur. Therefore, in order to inhibit the temperature variation of the workpiece W and improve the carburizing quality, it is preferable to perform the soaking step after sufficiently heating the workpiece W under an inert gas atmosphere.

(Carburizing and Diffusion Step)

After the inside of the heating chamber 10 has the vacuum atmosphere, a carburizing gas (for example, acetylene gas) is supplied into the heating chamber 10 that has reached the carburizing temperature, while continuing the vacuum evacuation. At this time, the pressure inside the heating chamber 10 is maintained to be $1\times10^5$ Pa or less, and in this state, vacuum carburizing on the workpiece W is started. Then, after maintaining this state for a certain period of time, the supply of the carburizing gas is stopped and the workpiece W is subjected to a diffusion treatment.

(Lowering Temperature and Secondary Soaking Step)

After the diffusion treatment is completed, the vacuum evacuation is stopped, and a nitrogen gas is supplied to the heating chamber 10 while the stirring fan 13 stirring the atmosphere in the heating chamber 10. Then, after the pressure inside the heating chamber 10 reaches a predetermined pressure (for example, $5\times10^4$ Pa), the supply of the nitrogen gas is stopped. This state is maintained for a certain period of time to perform lowering the temperature and a secondary soaking treatment on the workpiece W. The pressure inside the heating chamber 10 is preferably maintained to be a pressure greater than $1\times10^3$ Pa and less than the atmospheric pressure. By maintaining the pressure inside the heating chamber 10 to be a pressure greater than $1\times10^3$ Pa and less than the atmospheric pressure, the temperature variation of the workpiece W can be inhibited with the convection heat transfer by the stirring fan 13.

Further, in the lowering temperature and secondary soaking step, when the pressure inside the heating chamber 10 is less than the atmospheric pressure, the pressure inside the heating chamber 10 becomes lower than the pressure outside the heating chamber 10, and the force that presses the lid body 33 against the bottom portion 10*a* of the heating chamber 10 is applied. Incidentally, when the pressure inside the heating chamber 10 is made lower than the pressure outside the heating chamber 10, the pressure difference is preferably $5\times10^4$ Pa or less.

(Conveying Step)

After lowering the temperature and the secondary soaking treatment on the workpiece W are completed, as illustrated in FIG. 6(B), the door 15 installed at the side wall of the heating chamber 10 is opened, and the workpiece W is conveyed from the heating chamber 10 to the cooling chamber 40. Thereafter, the door 15 is closed. The workpiece W conveyed to the cooling chamber 40 is quenched in the oil tank 41 and then conveyed out of the cooling chamber 40.

Incidentally, if the state where the workpiece W of the next lot is not charged into the heating chamber 10 is continued after the workpiece W is conveyed to the cooling chamber 40, the pressure inside the heating chamber 10 increases to be greater than the pressure outside the heating chamber 10. Thereby, a downward force acts on the lid body 33, and thus the scissor lifter 30 needs to be operated in order to prevent the lid body 33 from lowering.

Therefore, after the workpiece W is conveyed to the cooling chamber 40, the pressure inside the heating chamber 10 is preferably maintained at less than the atmospheric pressure. This makes the pressure inside the heating chamber 10 lower than the pressure outside the heating chamber 10, and the force that presses the lid body 33 against the bottom portion 10*a* of the heating chamber 10 is applied.

As a result, the operation of the scissor lifter 30 aiming to prevent the lid body 33 from lowering is no longer required, resulting in that the load on the motor of the scissor lifter 30 can be reduced. Incidentally, when the pressure inside the heating chamber 10 is made lower than the pressure outside the heating chamber 10, the pressure difference is preferably $5\times10^4$ Pa or less.

By the above steps, the vacuum carburizing treatment on the workpiece W for one lot is completed. Then, when the workpiece W of the next lot is charged into the heating chamber 10, the charging step described above is performed again. That is, the nitrogen gas is supplied into the heating chamber 10, and the charging port 23 is opened in a state where the pressure inside the heating chamber 10 has become a pressure equal to or higher than the atmospheric pressure. As a result, there is no pressure difference between the inside and outside of the heating chamber 10, or the pressure inside the heating chamber 10 is higher than the pressure outside the heating chamber 10, therefore making it difficult for the outside air to flow into the heating chamber 10 when the charging port 23 is opened.

After the charging port 23 is opened, the lid body 33 is lowered to the initial position and the workpiece W to be carburized next is placed on the support table 31. Then, the vacuum carburizing treatment on the workpiece W is performed according to the treatment flow illustrated in FIG. 5. By performing such a treatment repeatedly, the vacuum carburizing treatment is performed also on the subsequent workpieces W in sequence.

The vacuum carburizing treatment method using the vacuum carburizing furnace 1 according to this embodiment has been explained above. According to the vacuum carburizing furnace 1, when the workpiece W is charged into the heating chamber 10, the workpiece W is charged from the bottom portion 10*a* of the heating chamber 10. This makes it possible to inhibit the inflow of outside air into the heating chamber 10 when the workpiece W is charged, as will be explained in a later-described example.

As a result, the structures inside the heating chamber 10 are less likely to oxidize, and materials other than oxidation-resistant materials can be employed as the material for the structure. For example, in a conventional vacuum carburizing furnace, the employment of a carbon composite material as the material for the stirring fan 13 has been avoided due to concerns about oxidation resistance, but with the vacuum carburizing furnace 1 according to this embodiment, oxidation of the structure inside the heating chamber 10 is inhibited, resulting in that the carbon composite material can be employed. This makes it possible to reduce the weight of the stirring fan 13.

In the foregoing, one example of the embodiment of the present invention has been described, but the present invention is not limited to such an example. It is apparent that those skilled in the art are able to devise various variation or modification examples within the scope of the technical spirit described in the claims, and it should be understood that such examples belong to the technical scope of the present invention as a matter of course.

Examples

Figure 7:
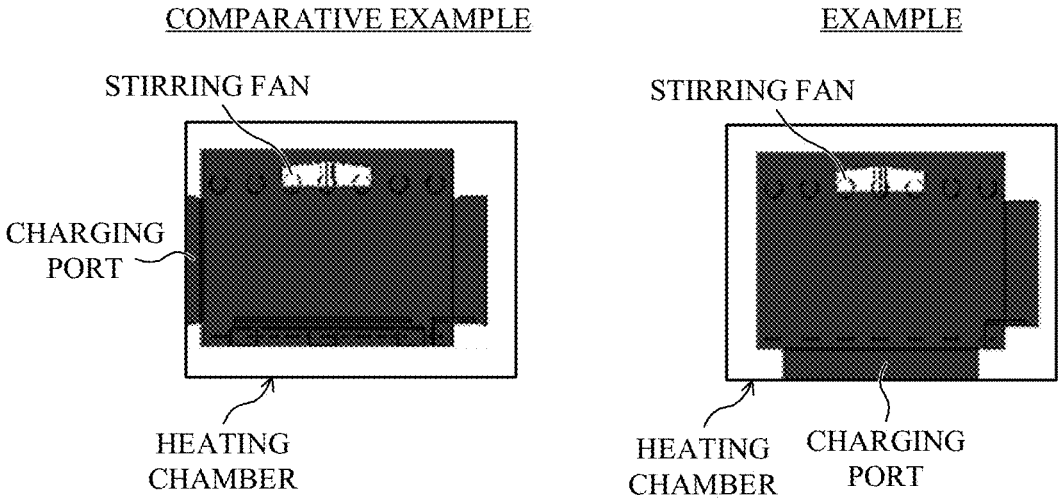
FIG. 7 is a view illustrating analysis models of a simulation.

A simulation was conducted to evaluate the inflow of outside air into the heating chamber, using analysis models of the heating chamber illustrated in FIG. 7. In the model in a comparative example illustrated in FIG. 7, the charging port for a workpiece was formed on the side of the heating chamber, while in the model in an example, the charging port for a workpiece was formed at the bottom portion of the heating chamber.

The analysis conditions for the simulation are as follows. In this simulation, a distinction was made between the air inside the heating chamber and the air outside the heating chamber in an initial state, and attention was focused on the variation over time in the concentration of each air.

Figure 8:
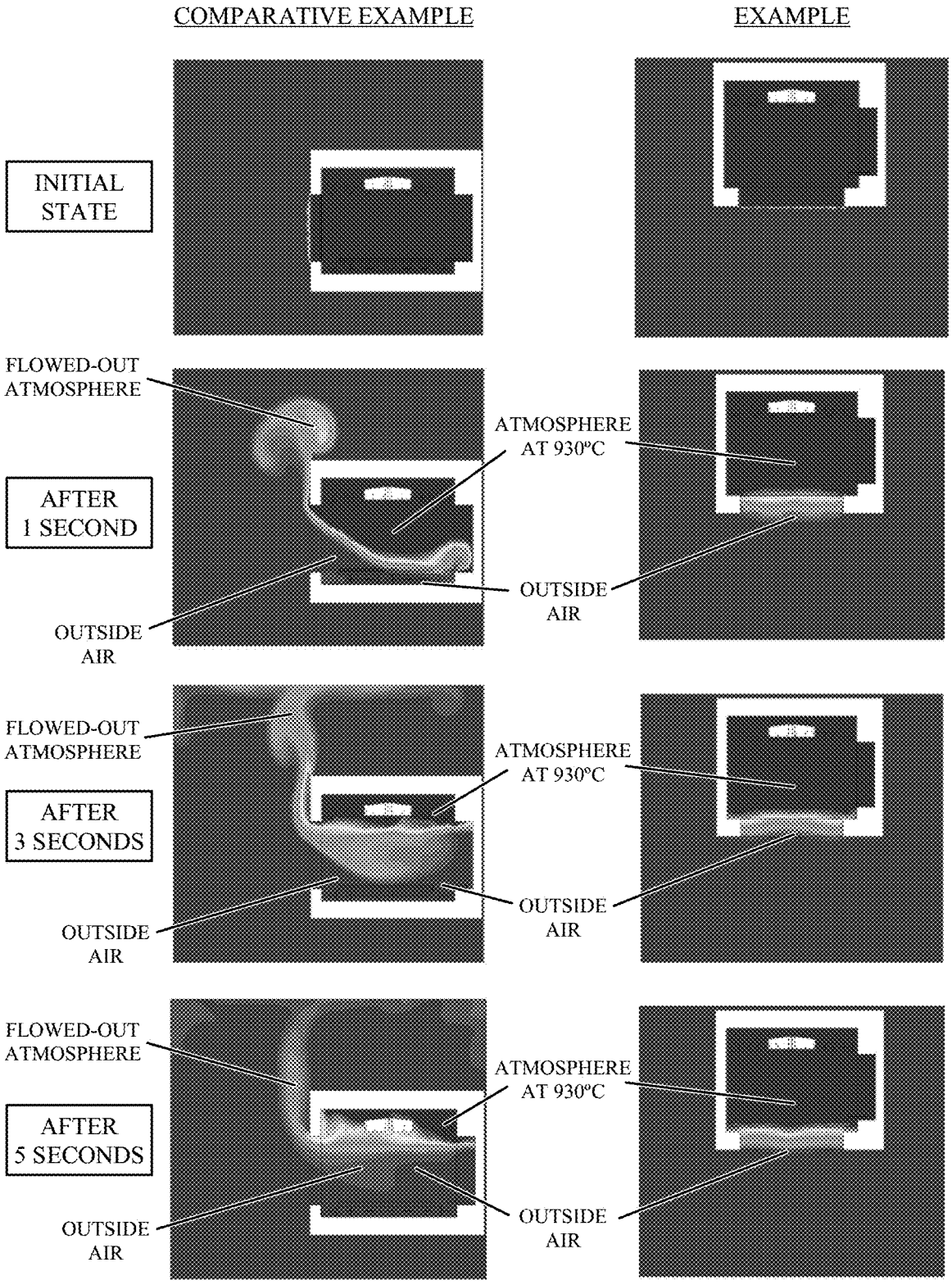
FIG. 8 is a view illustrating results of the simulation.

- Analysis type: Fluid concentration analysis in unsteady flow
- Analysis time: 30 seconds
- Boundary conditions
  - Boundary between heating chamber and fluid: Stationary wall
  - Boundary between region outside heating chamber and region outside analysis range: Stationary wall
- Heat transfer conditions
  - Fluid and fluid: Heat transfer exists
  - Fluid and solid: Heat insulation
  - Fluid and region outside analysis range: Heat insulation
- Physical properties
  - Atmosphere inside heating chamber: Air at 930° C.
  - Atmosphere outside heating chamber: Air at 25° C.
  - Heating chamber material: Carbon steel for machine structural use FIG. 8 is a view illustrating results of the simulation. As illustrated in FIG. 8, in the model in the comparative example in which the charging port was provided on the side of the heating chamber, outside air flowed into the heating chamber immediately after the start of the simulation, and 5 seconds after the start, most of the atmosphere inside the heating chamber was replaced with the outside air.

On the other hand, in the model in the example in which the charging port was provided at the bottom portion of the heating chamber, there was no inflow of outside air into the heating chamber, and the atmosphere inside the heating chamber was maintained as it is in an initial state. Incidentally, FIG. 8 illustrates only the results for the first 5 seconds after the start of the simulation, but even in the results after 30 seconds, when the simulation was completed, no inflow of outside air into the heating chamber was confirmed in the model in the example.

The results in this example reveal that the vacuum carburizing furnace having a structure in which the workpiece is charged from the bottom portion of the heating chamber exhibits a significant effect in terms of inhibiting the inflow of outside air, compared to the vacuum carburizing furnace having a structure in which the workpiece is charged from the side of the heating chamber.

INDUSTRIAL APPLICABILITY

The present invention can be applied to a vacuum carburizing furnace in which a carburizing treatment on a workpiece is performed.

EXPLANATION OF CODES

1 vacuum carburizing furnace
10 heating chamber
10*a* bottom portion of heating chamber
11 heat insulating material
12 heater
13 stirring fan
14 conveyance port
15 door
16 pusher
17 opening portion
18 housing
19 exhaust pipe
20 vacuum pump
21 pressure gauge
22 gas inlet
23 charging port
30 scissor lifter
31 support table
32 heat insulating material
33 lid body
34 contact member
35 limit switch
36 detection part
40 cooling chamber
41 oil tank
42 elevator rack
43 conveyance port
44 conveyance-out port
45 door
100 control device

The invention claimed is:

1. A vacuum carburizing furnace, comprising a heating chamber in which a vacuum carburizing treatment is performed on a workpiece to be charged from outside the furnace;

a charging port for the workpiece, the charging port provided at a bottom portion of the heating chamber;

an elevator that is arranged below the heating chamber and charges the workpiece into the heating chamber from the charging port;

a support table that supports the workpiece;

a lid body provided below the support table, the lid body that covers the charging port;

an opening/closing detection mechanism that detects opening and closing of the charging port; and a control device that controls the elevator, wherein the elevator has a configuration that raises and lowers the lid body, the lid body has a shape that, when raised, comes into close contact with a bottom portion of the heating chamber to close the charging port, and the control device is configured to perform control to raise the elevator and raise the lid body when the opening/closing detection mechanism detects that the charging port is opened at an unprescribed timing.

2. The vacuum carburizing furnace according to claim 1, further comprising:

a control device that controls opening and closing of the charging port, wherein the control device is configured to, when opening the charging port, perform control to open the charging port after an inert gas is supplied to the heating chamber and the pressure inside the heating chamber becomes a pressure equal to or higher than an atmospheric pressure.

3. The vacuum carburizing furnace according to claim 1, further comprising:

a control device that controls an atmosphere inside the heating chamber, wherein the control device is configured to perform control to maintain the inside of the heating chamber in an inert gas atmosphere and at a pressure of $1\times10^2$ Pa or more and less than an atmospheric pressure for a time of 50% or more of the time from when the charging port is closed until the temperature inside the heating chamber increases to a temperature at which the vacuum carburizing treatment is performed.

4. The vacuum carburizing furnace according to claim 1, wherein the heating chamber includes a gas supply port that supplies an oxidizing gas when performing burnout inside the heating chamber.

5. The vacuum carburizing furnace according to claim 1, further comprising:

a cooling chamber arranged adjacent to the heating chamber, the cooling chamber into which the workpiece that has been subjected to a carburizing treatment under a vacuum atmosphere is charged.

6. The vacuum carburizing furnace according to claim 1, wherein the opening/closing detection mechanism is a mechanism using a limit switch, a proximity sensor, a photoelectric sensor or a laser sensor.

* * * * *